United States Patent [19]

Merrill et al.

[11] Patent Number: 5,034,158

[45] Date of Patent: Jul. 23, 1991

[54] MONIONIC SURFACTANT BASED POWDERED LAUNDRY DETERGENT FORMULATION CONTAINING AN ALKENYL OR ALKYL CARBOXYSULFONATE COMPONENT

[75] Inventors: Connie L. Merrill, Katy; Donald L. Wood, Houston, both of Tex.

[73] Assignee: Shell Oil Company, Houston, Tex.

[21] Appl. No.: 425,905

[22] Filed: Oct. 24, 1989

[51] Int. Cl.[5] ..... C11D 1/18; C11D 3/065; C11D 3/30

[52] U.S. Cl. ..... 252/545; 252/174.21; 252/526; 252/554; 252/557; 252/DIG. 1

[58] Field of Search ..... 252/526, 557, 545, 554, 252/174.21, DIG. 1

[56] References Cited

U.S. PATENT DOCUMENTS

| | | | |
|---|---|---|---|
| 2,089,348 | 8/1937 | Doser et al. | 260/127 |
| 2,192,906 | 3/1940 | Hanford et al. | 260/458 |
| 2,379,535 | 7/1945 | Lynch et al. | 260/480 |
| 2,383,130 | 8/1945 | Jaeger et al. | 260/513 |
| 3,086,043 | 4/1963 | Gaertner | 260/485 |
| 3,317,589 | 5/1967 | Vitalis et al. | 260/513 |
| 3,732,290 | 5/1973 | Danzik | 260/507 R |
| 3,793,226 | 2/1974 | Danzik | 252/526 |
| 3,843,707 | 10/1974 | Danzik et al. | 260/458 |
| 3,869,412 | 3/1975 | Waag | 252/527 |
| 3,903,138 | 9/1975 | Danzik | 260/485 J |
| 3,912,663 | 10/1975 | Lamberti | 252/542 |
| 3,923,856 | 12/1975 | Danzik et al. | 260/458 |
| 3,927,061 | 12/1975 | Danzik et al. | 260/458 |
| 4,790,856 | 12/1988 | Wixon | 8/137 |

OTHER PUBLICATIONS

Katstra, R. D. et al "Controlled Foam Laundry Formulations" *J.A.O.C.S.*, vol. 49, Jan. 1972, pp. 38–43.

*Primary Examiner*—Paul Lieberman
*Assistant Examiner*—Alexander G. Ghyka

[57] ABSTRACT

A nonionic surfactant based powdered laundry detergent formulation which consists essentially of between about 15 and about 25 percent by weight of one or more nonionic surfactants, between about 1 and 10 percent by weight of one or more of certan carboxysulfonate compounds which may be prepared, for example, by the direct reaction of a hydrocarbyl succinic anhydride with either an aminoalkyl sulfonate or a salt of isethionic acid, between about 2 and about 10 percent by weight of a silicate salt anticorrosion agent, between about 2 and about 40 percent by weight of detergent builder, and a sulfate salt filler. The combination of nonionic surfactant and anionic carboxysulfonate surfactant in the formulation provides a highly effective detergent performance. However, the formulation retains the beneficial properties of mildness, low foam generation, and biodegradability characteristic of nonionic surfactants. The formulation is very effective for removal of particulate soils from fabrics and for preventing their redeposition onto the fabrics during the laundry wash cycle.

21 Claims, No Drawings

MONIONIC SURFACTANT BASED POWDERED LAUNDRY DETERGENT FORMULATION CONTAINING AN ALKENYL OR ALKYL CARBOXYSULFONATE COMPONENT

The present invention relates to a nonionic surfactant based powdered laundry detergent formulation, and more particularly to a biodegradable, low-foaming nonionic surfactant based built formulation containing one or more of certain alkenyl or alkyl carboxysulfonate compounds.

SUMMARY OF THE INVENTION

The present invention provides a nonionic surfactant based, biodegradable, low-foaming powdered laundry detergent formulation which consists essentially of (a) between about 15 and about 25 percent by weight of one or more nonionic surfactants selected from the group consisting of alcohol ethoxylate surfactants and alkyl-substituted phenol ethoxylate surfactants having an average of between about 4 and 12 ethylene oxide units per ethoxylate molecule, (b) between about 1 and about 10 percent by weight of one or more carboxysulfonate compounds of the formula $$\mathrm{XOOC{-}\overset{(R^1)_p}{\overset{|}{C}}H(H)_q{-}\overset{(R^1)_q}{\overset{|}{C}}H(H)_p{-}\overset{O}{\overset{\|}{C}}{-}Z{-}CH_2{-}CH_2{-}SO3M,} \qquad \text{(I)}$$

wherein $R^1$ represents an alkyl or alkenyl group having a carbon number in the range of from about 9 to about 18, p is either 0 or 1, q is 0 when p is 1 and q is 1 when p is 0, X is either a hydrogen atom or is M, Z represents either an oxygen atom, a sulfur atom or the amide group $-N(R^2)-$ wherein $R^2$ is lower hydrocarbyl, particularly $C_1$ to $C_4$ alkyl, and each M is a salt forming cation, preferably an alkali metal or ammonium cation, with the further provision that the sum of components (a) and (b) is between about 20 and about 35 percent by weight, (c) between about 2 and about 10 percent by weight of a silicate salt anticorrosion agent, (d) between about 2 and about 40 percent by weight of detergent builder, and (e) a sulfate salt filler.

The combination of nonionic surfactant and anionic carboxysulfonate surfactant in the formulation provides a highly effective detergent performance. However, the formulation retains the beneficial properties of mildness, low foam generation and biodegradability characteristic of nonionic surfactants. The formulation is very effective for removal of both particulate and oily soils from fabrics and for preventing their redeposition onto the fabrics during the laundry wash cycle.

The alkenyl or alkyl carboxysulfonate ("ACS") compounds serve as multi-functional components in the formulation. Functioning as anionic surfactant, the presence of these compounds aids in the removal of particulate and polar soils. Unlike the anionic surfactants commonly formulated into conventional nonionic based products, the ACS surfactant component of this invention generates relatively little foam in aqueous wash solutions, a property which is very desirable in laundry applications. The ACS component further aids in sequestering $Ca^{+2}$ and $Mg^{+2}$ ions in water, providing a formulation which is tolerant to hard water wash applications. In combination with the builder component specified, the ACS component provides a level of builder performance only obtained with substantially higher levels of conventional detergent builders. Still further, the ACS component acts as an "anti-redeposition" agent, facilitating the suspension of soil in the washwater and its effective separation from laundry fabrics. These several functions of the ACS compounds provide a simplified but very effective formulation in terms of both its detergent performance and physical properties.

DETAILED DESCRIPTION OF THE INVENTION

The nonionic surfactant component of the invention is suitably made up of one or more ethylene oxide adducts (i.e., "ethoxylates") of alcohols or alkyl-substituted phenols, and can be represented by the formula $R{-}O{-}(CH_2CH_2O)_n{-}H$, wherein the RO group corresponds to the starting alcohol or alkyl-substituted phenol (less its active hydrogen atom). In general, the suitable alkanol ethoxylates are derived from alcohols, particularly alkanols, in the carbon number range from about 9 to 16, while the suitable alkylphenol ethoxylates are derived from those having alkyl substituents in the carbon number range from about 8 to 12. Both the alkanol ethoxylates and the phenol ethoxylates are nonionic surfactants well known as components of conventional laundry detergent products.

With regard to the use of alkanol ethoxylate surfactants, the individual compounds are preferably characterized by an alkyl R group in the carbon number range from about 11 to 15. Both primary and secondary alkanol ethoxylates (having primary or secondary alkyl R groups, respectively) are suitable in the invention. The R group is suitably linear or branched.

The alkyl-substituted phenol ethoxylate compounds preferably have an alkyl substituent with between about 8 and about 11 carbon atoms. The alkyl substituent may be either branched or linear.

The suitable nonionic ethoxylate surfactants contain an average number of ethylene oxide units (i.e., an average value of n in the above formula) which is in the range from about 4 to 12 per molecule. Preferably the ethoxylate surfactants contain an average number of ethylene oxide units which is in the range from about 5 to 9 per molecule.

The carboxysulfonate ACS component suitable for the formulation of the invention contains one or more compounds of the formula $$\mathrm{XOOC{-}\overset{(R^1)_p}{\overset{|}{C}}H(H)_q{-}\overset{(R^1)_q}{\overset{|}{C}}H(H)_p{-}\overset{O}{\overset{\|}{C}}{-}Z{-}CH_2{-}CH_2{-}SO3M,} \qquad \text{(I)}$$

wherein $R^1$ represents an alkyl or alkenyl group having a carbon number in the range of from about 9 to about 18, p is either 0 or 1, q is 0 when p is 1 and q is 1 when p is 0, X is either a hydrogen atom or is M, Z represents either an oxygen atom, a sulfur atom or the amide group $-N(R^2)-$ wherein $R^2$ is lower hydrocarbyl, particularly $C_1$ to $C_4$ alkyl, and each M is a salt forming cation, preferably an alkali metal or ammonium cation. When the Z substituent is a $-N(R^2)-$ group, the $R^2$ moiety is most preferably methyl. The alkyl or alkenyl group $R^1$ preferably has a carbon number in the range from about 12 to about 18, and more preferably a carbon number in the range from about 12 to about 16, and most preferably a carbon number of about 14. The Z substituent is preferably an oxygen atom or an amide group.

For enhanced biodegradability, it is preferred that the alkyl group R of the alkanol ethoxylates, the alKyl substituent of the alkyl-substituted phenols, and the alkyl or alkenyl group $R^1$ of the ACS molecule all be of predominantly linear carbon chain structure. In this respect, it is particularly preferred that the surfactant molecules be essentially free of alkyl or alkenyl groups having multiple branches in the carbon chain, such as result, for instance, from synthesis via the oligomerization of lower olefins such as propylene and the butylenes.

The formulation of the invention comprises between about 15 and about 25 percent by weight (% w) of the nonionic surfactant component and between about 1 and about 10% w of the ACS component. Formulations containing between about 17 and about 23% w of the nonionic surfactant and between about 2 and about 8% w of the ACS component are preferred, while formulations containing between about 18 and about 22 percent of the nonionic surfactant and between about 3 and about 5% w of the ACS component are generally more preferred. Preferably, the nonionic surfactant component and the ACS component together total between about 20 and about 30 percent by weight.

Also present in the formulation is a silicate anticorrosion agent, in an amount between about 2 and about 10% w. Alkali, alkaline earth and ammonium silicate salts are conventionally applied for this service and are very suitable for use in this invention. Sodium silicate is particularly preferred. The silicate component is present in the formulation in a quantity between about 2 and about 10% w, preferably in a quantity between about 3 and about 8% w, and most preferably in an amount between about 4 and about 6% w.

The formulation further necessarily contains a detergent builder component. Builders are known to be added to powdered detergent formulations to enhance cleaning performance by softening water and providing alkalinity and buffering capacity to the wash. The builder component is preferably one or more materials selected from the group consisting of hydratable alkali metal phosphates, alkali metal carbonates and bicarbonates (mixed or separate, anhydrous or partially hydrated), zeolites (either crystalline or amorphous, and either natural or synthetic), ethylenediamine tetraacetate, and nitrilotriacetate. Phosphates and carbonates are particularly preferred. For purposes of the invention the builder is present in the formulation in an amount between about 2 and about 40% w, preferably in an amount between about 2 and about 20% w, and most preferably in an amount between about 3 and 6% w. The quantity of builder typically required for this formulation is substantially reduced by the co-builder function which is served by the ACS compounds. In this respect, the co-building properties of the ACS surfactant provides a very cost-effective formulation.

The balance of the formulation consists essentially of a sulfate salt. This component is an inert solid powder which functions as a filler for the formulation. Sodium sulfate is most preferred.

In addition to its five principal components, the formulation of the invention may suitably contain minor amounts of other components known in the art for use in such products (e.g., dyes, fragrances, bleaches, bleach activators, enzymes, etc.).

In particular, the formulation does not contain materials such as sodium polyacrylate and/or sodium carboxymethylcellulose which have been added to conventional products as anti-redeposition agents to facilitate the dispersion of soils into the wash and rinse waters. The ACS component serves as an effective anti-redeposition agent for this formulation. Elimination of the need for polyacrylates and like anti-redeposition agents is significant not only from the standpoint of cost but also from the standpoint of biodegradability. In general, conventional anti-redeposition agents such as sodium polyacrylate are known to biodegrade slowly and/or incompletely.

The five principal components of the invention are suitably blended into the finished formulation by conventional methods for the preparation of powdered detergent formulations, for instance, by the spray drying an aqueous mixture of the builder and the filler to form base beads, followed by blending of the beads with the surfactants and other components; by dry blending or agglomeration techniques; or by the spraying of nonionic surfactant onto blends or agglomerates of the other components.

The ACS amide compounds and their preparation have been described by M. Danzik in U.S. Pat. No. 3,793,226 and U.S. Pat. No. 3,732,290. These patents are directed to a class of "monoamide hydrocarbyl sulfonic acid salts of hydrocarbyl succinic acid", including ACS compounds of formula I wherein Z is a $-N(R^2)-$ group and $R^2$ is hydrogen or alkyl. These compounds were prepared by the direct reaction of a hydrocarbyl succinic anhydride with an aminohydrocarbyl sulfonic acid salt. Stoichiometric quantities of the anhydride and the amino sulfonic acid salt, were contacted under neutral or basic conditions at temperatures in the range of 100° to 220° C. The procedures of Danzik can be followed for the preparation of the compounds of the invention, using an alkenylsuccinic anhydride wherein the alkenyl radical corresponds to the $R^1$ substituent in the above formula and a salt of an alkyl amino sulfonic acid such as N-methyltaurine, N-ethyltaurine, etc. It has been found to be preferred to carry out the reaction of alkenyl succinic anhydride with an equimolar quantity or a small excess (e.g., up to a 10% stoichiometric excess, particularly a 2–5% excess) of the aminohydrocarbyl sulfonic acid salt at a temperature in the range from about 140° to 160° C. The reaction is preferably carried out in a solvent, for instance, xylene or toluene. Preferably, the alkyl substituent $R^2$ in the ACS molecule is in the carbon number range from 1 to about 4. Most preferably, it is methyl.

ACS compounds wherein Z in the above formula represents oxygen have been described by V. R. Gaertner in U.S. Pat. No. 3,086,043 and by M. Danzik and R. House in U.S. Pat. No. 3,903,138. These compounds were prepared by contacting the corresponding alkenyl succinic anhydride with a salt of isethionic acid. This reaction has been found to be preferably conducted with an equimolar quantity or a small excess (e.g., up to a 10% stoichiometric excess, particularly a 2–5% excess) of the isethionic acid salt at a temperature in the range from about 120° to 140° C. The use of a reaction solvent, for instance, xylene or toluene, is preferred.

In either case, if the reaction is carried to substantially complete conversion, so that the product mixture contains at least about 80% w of the ACS, this mixture is suitable for use directly in the formulation of the invention. The product mixture preferably contains at least about 85% w of ACS and more preferably about 90% w of ACS. Physical separation steps, obvious to those of skill in the art, can be applied for removal of excess reactants from a product mixture to bring its ACS content to the desired level.

The teachings of the Danzik, Danzik et al and Gaertner patents are incorporated herein by this reference, insofar as they are relevant to the preparation of ACS compounds useful in this invention.

When prepared by the reaction of an alkenylsuccinic anhydride, the ACS compounds have an alkenyl $R^1$ substituent. Alkyl-substituted ACS compounds can be prepared from alkenyl succinic anhydride compounds which have first undergone hydrogenation of the double bond of the alkenyl group. Hydrogenation can be easily accomplished by, for example, contact with hydrogen (at a partial pressure of 500 psi) in the presence of a 10% palladium-on-carbon catalyst at a temperature of 100° C. The alkyl-substituted ACS compounds are typically more stable when applied together with bleach, but otherwise generally exhibit performance characteristics similar to those of the corresponding alkenyl-substituted compounds.

The cited patents of Danzik and Danzik and House identify the ACS compounds as biodegradable synthetic detergents which can be applied without phosphate builders. The prior art patents describe the use of the ACS materials in anionic based detergent formulations. They fail to disclose nonionic surfactant based detergent formulations containing ACS compounds.

Although the Gaertner patent describes the ACS compounds as useful in applications where a high level of foaming or sudsing activity is demanded, it is considered to be of particular advantage that the ACS containing formulations of this invention generate low levels of foam.

The invention is further described with reference to the following examples, which are intended to illustrate certain particularly preferred aspects of the invention, without limiting its broader scope.

EXAMPLES 1-7

Characterization of ACS compounds derived from an N-methyl taurine salt.

A series of ACS compounds useful in formulating compositions according to the invention were prepared by the addition of the sodium salt of N-methyl taurine to different alkenyl succinic anhydride (ASA) compounds. The ASA compounds were distinguished one from the other by the presence of alkenyl groups of different carbon number, which correspond to different $R^1$ groups (formula I above) in the ACS products. $R^1$ groups were essentially all linear. Duplicate preparations were made of ACS surfactants having $C_{16}$ and $C_{18}$ substituents.

In each case, the compounds were prepared by contact of the ASA compound with a 0 to 3% stoichiometric excess of the sodium salt of N-methyl taurine, added as a dry powder to the melted ASA at elevated temperature, i.e., a temperature sufficient to maintain a mobile fluid, under continuous stirring. All of the materials were obtained in the sodium salt form. Synthesis reaction parameters are presented in the following Table.

| Example No. | ASA $R^1$ Group | Reaction Temp. (°C.) | Reaction Time (Min.) |
|---|---|---|---|
| 1 | $C_{12}$ | 176–185 | 85 |
| 2 | $C_{14}$ | 180–191 | 60 |
| 3 | $C_{16}$ | 160–200 | 205 |
| 4 | $C_{16}$ | 155–162 | 225 |
| 5 | $C_{18}$ | 170–195 | 195 |
| 6 | $C_{18}$ | 145–165 | 350 |
| 7 | $C_{22}$–$C_{24}$ | 170–195 | 120 |

Surface tension of each of the ACS products of examples 1–7 was measured for 0.001% w, 0.01% w, 0.1% w, 1.0% w, 5.0% w and 10% w solutions in water. For surface tension measurements of the $C_{16}$-substituted ACS products, a mixture of the two products of examples 3 and 4 was tested. For surface tension measurements of the $C_{18}$-substituted ACS products, a mixture of the two products of examples 5 and 6 was tested. Results are presented in the following table. (The $C_{16}$- and $C_{18}$-substituted products alone were not soluble in water at concentrations of 1.0% w or greater.)

| Example | Surface Tension (Dynes/cm$^2$) at Concentrations of: | | | | | |
|---|---|---|---|---|---|---|
| No. | 0.001% w | 0.01% w | 0.1% w | 1.0% w | 5.0% w | 10.0% w |
| 1 | 58 | 32 | 26 | 27 | 30 | 30 |
| 2 | 49 | 30 | 27 | 28 | 30 | 30 |
| 3 + 4 | 36 | 30 | 29 | | | |
| 5 + 6 | 39 | 35 | 33 | | | |

Measurements were also made of critical micelle concentration (cmc) for two of the ACS products in water solution. Critical micelle concentration is the minimum concentration of the surfactant at which micelles begin to form, and indicates the minimum surfactant concentration necessary for detergency. The product in example 1 showed a critical micelle concentration of 0.03% w, while that in example 2 exhibited a critical micelle concentration of 0.01% w. These results are in the range of cmc values characteristic of nonionic surfactants and much lower than cmc values for common anionic surfactants. (For instance, cmc for a linear $C_{12}$-alkyl substituted benzene sulfonate surfactant was measured as 0.4%.) The low cmc values mean that the ACS products are effective detergents when applied at low concentration in wash water solutions.

EXAMPLES 8-13

Characterization of ACS compounds derived from an isethionic acid salt.

Another series of ACS compounds useful in formulating compositions according to the invention were prepared by the addition of the sodium salt of isethionic acid to different alkenyl succinic anhydride (ASA) compounds. The ASA compounds were, as in examples 1–7, distinguished one from the other by the presence of alkenyl groups of different carbon number, which correspond to different $R^1$ groups (formula I above) in the ACS products. $R^1$ groups were essentially all linear. Duplicate preparations are shown for ACS surfactants having $C_{16}$ and $C_{18}$ substituents.

In each case, the compounds were prepared by contact of the ASA compound with a 0 to 3% stoichiometric excess of isethionate (the sodium salt of isethionic acid was added as a dry powder to the melted ASA at elevated temperature, i.e., a temperature sufficient to maintain a mobile fluid) under continuous stirring. All of the ACS materials were obtained in the sodium salt form. Synthesis reaction parameters are presented in the following table.

| Example No. | ASA $R^1$ Group | Reaction Temp. (°C.) | Reaction Time (Min.) |
|---|---|---|---|
| 8 | $C_{12}$ | 122–137 | 65 |
| 9 | $C_{14}$ | 120–135 | 390 |
| 10 | $C_{16}$ | 145–170 | 330 |
| 11 | $C_{16}$ | 135–140 | 360 |
| 12 | $C_{18}$ | 145–188 | 150 |
| 13 | $C_{18}$ | 137–146 | 420 |

Surface tension of each of the ACS products in examples 8–13 were measured for 0.001% w, 0.01% w, 0.1% w, 1.0% w, 5.0% w and 10% w solutions in water. For surface tension measurements of the $C_{16}$-substituted ACS products, a mixture of the two products of examples 10 and 11 was tested. For surface tension measurements of the $C_{18}$-substituted ACS products, a mixture of the two products of examples 12 and 13 was tested. Results are presented in the following table. (The $C_{18}$-substituted product alone was not soluble in water alone at concentrations of 1.0% w or greater.)

| Example No. | Surface Tension (Dynes/cm$^2$) at Concentration of | | | | | |
|---|---|---|---|---|---|---|
| | 0.001% w | 0.01 % w | 0.1% w | 1.0% w | 5.0% w | 10.0% w |
| 8 | 65 | 44 | 31 | 34 | 35 | 36 |
| 9 | 44 | 30 | 31 | 33 | 33 | 32 |
| 10 + 11 | 40 | 32 | 32 | 32 | 32 | 32 |
| 12 + 13 | 39 | 35 | 33 | | | |

Measurements were also made of critical micelle concentration (cmc) for three of these ACS products in water solution. The product in example 8 showed a cmc of 0.05% w, while that in example 9 exhibited a cmc of 0.01% w. A mixture of the products of examples 10 and 11 had a cmc of 0.01% w.

EXAMPLES 14–19 AND COMPARATIVE EXPERIMENTS A AND B

Detergency performance evaluations

Evaluations were made of the detergency performance of a formulation according to the invention containing 20% w of a nonionic surfactant (a NEODOL Alcohol Ethoxylate, trademark of and sold by Shell Chemical Company, characterized as the addition product of an average of 5 mols of ethylene oxide to a mixture of substantially linear, primary $C_{12}$–$C_{13}$ alcohols, designated "N23-5"), 5% w of sodium silicate, 5% w of a builder (either a phosphate, carbonate or zeolite), 5% w of an ACS component, and 65% w of sodium sulfate.

In examples 14, 15 and 16, the ACS surfactant was an "ACS-taurine" prepared by reaction of N-methyl taurine with $C_{14}$-alkenyl succinic anhydride. The 5% builder component of the formulation was sodium tripolyphosphate (STPP) in the formulation tested in example 14, sodium bicarbonate/tricarbonate (CARB) in example 15 and a 4A-zeolite in example 16.

In examples 17, 18 and 19, the ACS surfactant was an "ACS-isethionate" prepared by reaction of an isethionate salt with a $C_{14}$-alkenyl succinic anhydride. The 5% builder component of the formulation was sodium tripolyphosphate (STPP) in the formulation tested in example 17, sodium bicarbonate/tricarbonate (CARB) in example 18 and a 4A-zeolite in example 19.

Standard procedures were followed for each of the detergency performance tests. Two 4"×4" permanent press 65/35 polyester/cotton fabric swatches pre-soiled with controlled amounts of a radiolabelled clay soil were washed in a Terg-O-Tometer (a laboratory scale apparatus which simulates the action of a household laundry washing machine) at 40° C. for 10 minutes in water having 150 ppm hardness (as $CaCO_3$). The detergent formulations tested were applied at a concentration of 0.7 grams per liter of wash water. After washing, the swatches were hand-rinsed and were radiocounted directly to measure clay soil removal.

Results of the detergency performance tests are presented in the following table, in terms of percent clay soil removal.

| Formulation of Example No. | ACS | Builder | Percent Clay Soil Removal |
|---|---|---|---|
| 14 | ACS taurine | STPP | 33% |
| 15 | ACS taurine | CARB | 31 |
| 16 | ACS taurine | zeolite | 32 |
| 17 | ACS isethionate | STPP | 34 |
| 18 | ACS isethionate | CARB | 31 |
| 19 | ACS isethionate | zeolite | 32 |

COMPARATIVE EXPERIMENTS A AND B

These comparative experiments illustrate the contribution which the ACS component makes as a co-builder to the detergency performance of the formulation of the invention.

For comparative experiment A, a formulation, not in accordance with the invention was prepared having the same 20% w content of N23-5, and the same 5% w content of sodium silicate as the formulations of examples 14–19. ACS was omitted from both of these comparative formulations. Builder level was increased to 30% w of STPP for the formulation of comparative experiment A, and to 30% of CARB for the formulation of comparative experiment B. Sodium sulfate, 45% w, made up the balance of these formulations.

Tests were made of the detergency performance of these comparative formulations, using the standard test procedures described for examples 14–19. The test of comparative formulation A resulted in removal of 32% of clay soil, while the test of comparative formulation B resulted in removal of only 26% of the clay soil.

When compared with the results of examples 14–19, the performance of these comparative formulations illustrates the contribution made by the ACS component as a co-builder in the formulation of the invention. Even at substantially higher total levels of builder, the performance of comparative formulations which omit ACS do not meet those of the ACS containing formulations. In combination with relatively small quantities of builder, the ACS component in compositions of this invention provides a level of builder performance only achieved with substantially higher levels of builders in the absence of ACS.

EXAMPLES 20–22 AND COMPARATIVE EXPERIMENTS C-G,

Soil anti-redeposition performance.

These examples illustrate that the formulation of the present invention has excellent soil anti-redeposition properties. Soil anti-redeposition is a measure of the tendency of soils removed from fabrics to remain suspended in the laundry wash water, rather than redeposit on the fabric being washed. Comparative tests, with formulations in which the ACS component was replaced with conventional anti-redeposition agents, show that the ACS component provides an important contribution to the soil-antiredeposition performance of the invention.

Tests of removal and redeposition of radiotracer-labelled clay soil were conducted under standard procedures. A clean permanent press 65/35 polyester/cotton fabric swatch (designated the "soil redeposition swatch") was placed in a Terg-O-Tometer with four pre-soiled fabric swatches and washed at 40° C. in wash water of 150 ppm hardness. The presoiled swatches contained a measured amount of radio-labelled clay soil. A series of five washing cycles was carried out, with the soil redeposition swatch air-dried between cycles and fresh soiled swatches used for each cycle. A "soil redeposition" value was calculated (on the basis of radiocountings of the washed swatch) as the percentage of soil deposited on the redeposition swatch, relative to the total soil available for redeposition (i.e., the sum of the soil removed from the soiled swatches and the soil deposited on the redeposition swatch during all previous wash cycles). Duplicate runs were made for each test, and the soil redeposition value is reported as the average of that observed in the duplicate runs. Detergency performance was also determined from radiocountings of the soiled swatches, before and after washing.

The tests for examples 20–24 were made in wash water solutions containing 0.70 grams per liter of a formulation containing 20% w of the N23-5 nonionic surfactant, 70% w of sodium tribicarbonate, 5% w sodium silicate and 5% w of either ACS or a soil anti-redeposition agent. In order to increase the severity of the test environment, the concentration of carbonate builder in the formulation tested was increased to the 70% w level (above that specified for the invention) by addition of builder and omission of inert filler. The high builder level promotes soil redeposition, increases the severity of the test, and enhances the reliability of comparisons between the anti-redeposition performance of the ACS and other agents.

For comparative experiments C and D, the ACS component of the formulation tested was replaced with two conventional antiredeposition agents sodium carboxymethylcellulose (CMC) and sodium polyacrylate (POLY), respectively. For comparative experiment E, the ACS was omitted and not replaced with any other agent. An ASA-taurine derivative and an ASA-isethionate derivative, each having a lower (i.e., $C_8$) carbon number alkenyl group than is specified for this invention, were also tested in comparative experiments F and G.

In all tests, the formulation was applied in the amount of 0.70 grams per liter of wash water.

The results of these tests show that the presence of ACS compounds in nonionic surfactant based formulations is responsible for effectively inhibiting soil redeposition during the wash process. It is also apparent from the results that the test procedures adequately distinguish clay detergency effects from clay redeposition effects.

| Example/ Experiment No. | ACS Compound/ Anti-Redeposition Agent | Detergency % Soil Removal | % Clay Redeposition |
|---|---|---|---|
| 20 | $C_{12}$-ASA-taurine | 32 | 0.02 |
| 21 | iso-$C_{16}$-ASA-taurine | 34 | 0.00 |
| 22 | $C_{12}$-ASA-isethionate | 34 | 0.02 |
| C | CMC | 33 | 0.03 |
| D | POLY | 34 | 0.00 |
| E | none | 33 | 0.88 |
| F | $C_8$-ASA-taurine | 33 | 0.59 |
| G | $C_8$-ASA-isethionate | 32 | 0.22 |

EXAMPLES 23 AND 24, AND COMPARATIVE EXPERIMENTS H and I

Insensitivity of the ACS component to water hardness.

One advantage of the formulation of the present invention is its tolerance to calcium ions in the wash water solution. Anionic surfactants in detergent formulations are generally known to be subject to precipitation from wash water solutions containing hard water ions, e.g., magnesium and particularly calcium. The tolerance of the present formulation to calcium ions in wash solutions is attributable to the tolerance of its anionic ACS component and the capability of that component to function as a detergent builder.

Sensitivity of two ACS compounds (one derived from reaction between a linear $C_{14}$-alkenyl substituted ASA and sodium N-methyl taurine salt and the other derived from reaction between a linear $C_{14}$-alkenyl substituted ASA and sodium isethionate) to calcium ions was determined by titration of test solutions of each of the compounds with calcium chloride, while monitoring light transmittance of the solution to determine turbidity resulting from precipitation of ACS salts. The measurements were carried out using a Brinkmann PC-800 dipping probe colorimeter, combined with a nonaerating stirrer. Test solutions were prepared at a concentration of 2 millimol ACS surfactant per liter with pH adjusted to 10 by addition of dilute NaOH. During the test, the solution was stirred at 2500 rpm and temperature was maintained at 40° C. Calcium ion addition rate was 4 millimol per hour.

Results of the addition of up to a total of 2 millimol per liter of calcium ions are presented in the following table. Also shown in the table are the results of two comparative tests (comparative experiments H and I) of the sensitivity of other anionic surfactants (one a linear $C_{12}$-alkyl-substituted benzene sulfonate, "$C_{12}$-LAS", and the other a coconut fatty acid) to calcium ions in the same test. Results are reported in terms of % turbidity (calculated as 100% minus % of light transmittance).

The results of calcium sensitivity tests were found to be influenced by the presence of reactants, particularly alkenyl succinic anhydride, in the ACS product mixtures used. (Alkenyl succinic anhydrides were observed to be very intolerant to calcium ions.) The $C_{14}$-ASA-taurine product tested in these Examples had an ACS concentration of about 83% w. The $C_{14}$-ASA-isethionate product had an ACS concentration of about 85% w.

| Example/ Comparative Experiment | Surfactant | Millimols Calcium Ion Per Liter | % Turbidity |
|---|---|---|---|
| 23 | $C_{14}$-ASA-taurine | 0.2 | 0 |
| | | 0.4 | 0 |
| | | 0.6 | 1 |
| | | 0.8 | 2 |
| | | 1.0 | 9 |
| | | 1.2 | 13 |
| | | 1.6 | 20 |
| | | 2.0 | 26 |
| | | 2.8 | 39 |
| 24 | $C_{14}$-ASA-isethionate | 0.2 | 0 |
| | | 0.8 | 0 |
| | | 1.0 | 0 |
| | | 1.6 | 0 |
| | | 2.0 | 8 |
| | | 2.8 | 18 |
| H | $C_{12}$-LAS | 0.6 | 2 |
| | | 0.8 | 14 |
| | | 1.0 | 27 |
| | | 1.4 | 42 |
| | | 2.0 | 67 |
| | | 2.6 | 88 |
| | | 3.0 | 94 |
| I | coconut fatty acid | 0.2 | 40 |
| | | 0.4 | 73 |
| | | 0.6 | 92 |
| | | 0.8 | 100 |
| | | 1.0 | 100 |

EXAMPLE 25

Foaming tests.

This example describes tests made of the foam properties of ACS compounds in aqueous (deionized water) solution. For these tests, solutions having an ACS surfactant concentration of either 0.1% w or 0.01% w were introduced into a dynamic spray foam test apparatus equipped with a cylinder for containing the solution and the foam, a pump to circulate solution from the bottom of the cylinder to the air spaced above the foam level at the top of the cylinder, a spray nozzle through which the circulating solution is sprayed into the air space, and a heating element to maintain constant liquid solution temperature (40° C.). Measurements were made of the height of foam above the liquid solution surface in the cylinder, after 10 minutes.

The results of these tests, presented in the following table, illustrate that the ACS compounds are low-foaming surfactants. The comparative data also presented illustrates that although the ACS compounds are anionic surfactants, their foam generation properties more closely resemble those of low-foaming nonionic surfactants such as N25-9 than they do those of higher-foaming anionic surfactants such as $C_{12}$-LAS. Application of ACS compounds in low-foaming laundry formulations is considered surprising in light of prior art teachings of the lather-inducing properties of ACS compounds.

| Surfactant | Concentration | Foam Height (cm) |
|---|---|---|
| $C_{12}$-ASA-isethionate | 0.01% w | 0 |
| $C_{14}$-ASA-isethionate | 0.01 | 13 |
| $C_{16}$-ASA-isethionate | 0.01 | 31 |
| $C_{18}$-ASA-isethionate | 0.01 | 28 |

-continued

| Surfactant | Concentration | Foam Height (cm) |
|---|---|---|
| $C_{12}$-ASA-taurine | 0.01% w | 0 |
| $C_{14}$-ASA-taurine | 0.01 | 6 |
| iso-$C_{16}$-ASA-taurine | 0.01 | 1.5 |
| $C_{16}$-ASA-taurine | 0.01 | 10 |
| $C_{18}$-ASA-taurine | 0.01 | 22 |
| $C_{12}$-ASA-isethionate | 0.1% w | 0 |
| $C_{14}$-ASA-isethionate | 0.1 | 29 |
| $C_{16}$-ASA-isethionate | 0.1 | 55 |
| $C_{18}$-ASA-isethionate | 0.1 | 50 |
| $C_{12}$-ASA-taurine | 0.1% w | 0 |
| $C_{14}$-ASA-taurine | 0.1 | 36 |
| iso-$C_{16}$-ASA-taurine | 0.1 | 20 |
| $C_{16}$-ASA-taurine | 0.1 | 47 |
| $C_{18}$-ASA-taurine | 0.1 | 51 |
| $C_{12}$-LAS | 0.01% w | 47 |
| $C_{12}$-LAS | 0.1 | 57 |
| N25-9 | 0.1% w | 47 |

We claim as our invention:

1. A nonionic surfactant based, biodegradable, low-foaming powdered laundry detergent formulation, which consists essentially of (a) between about 15 and 25 percent by weight of one or more nonionic surfactants selected from the group consisting of alcohol ethoxylate surfactants and alkyl-substituted phenol ethoxylate surfactants having an average of between about 4 and 12 ethylene oxide units per ethoxylate molecule, (b) between about 1 and about 10 percent by weight of one or more carboxysulfonate compounds of the formula $$\mathrm{XOOC{-}\overset{(R^1)_p}{\overset{|}{C}}H(H)_q{-}\overset{(R^1)_q}{\overset{|}{C}}H(H)_p{-}\overset{O}{\overset{\|}{C}}{-}Z{-}CH_2{-}CH_2{-}SO3M,} \quad (I)$$

wherein $R^1$ is selected from the group consisting of alkenyl and alkyl groups having a carbon numbers in the range of from about 9 to 18, p is 0 or 1, q is 0 when p is 1 and q is 1 when p is 0, X is selected from the group consisting of a hydrogen atom and an M cation, Z is selected from the group consisting of an oxygen atom and —N($R^2$)— groups wherein $R^2$ is $C_1$ to $C_4$ alkyl, and each M is a salt forming cation, with the further provision that the sum of components (a) and (b) is between about 20 and 35 percent by weight, (c) between about 2 and about 10 percent by weight of a silicate salt anticorrosion agent, (d) between about 2 and about 40 percent by weight of detergent builder, and (e) a sulfate salt filler.

2. The formulation of claim 1, wherein the one or more nonionic surfactants are alkanol ethoxylate surfactants.

3. The formulation of claim 1, wherein component (b) comprises one or more carboxysulfonate compounds wherein $R^1$ represents an alkenyl group having a carbon number in the range from about 12 to about 18.

4. The formulation of claim 3, wherein component (b) comprises one or more alkenyl carboxysulfonate compounds wherein Z represents an oxygen atom.

5. The formulation of claim 3, wherein component (b) comprises one or more alkenyl carboxysulfonate compounds wherein Z represents a —N($R^2$)— group.

6. The formulation of claim 2, wherein component (b) comprises one or more carboxysulfonate compounds wherein $R^1$ represents an alkenyl group having a carbon number in the range from about 12 to about 18.

7. The formulation of claim 6, wherein component (b) comprises one or more alkenyl carboxysulfonate compounds wherein Z represents an oxygen atom.

8. The formulation of claim 6, wherein component (b) comprises one or more alkenyl carboxysulfonate compounds wherein Z represents a $—N(R^2)—$ group.

9. The formulation of claim 1, wherein the one or more carboxysulfonate compounds are a mixture of compounds wherein $R^1$ represents an alkenyl group having a carbon number in the range from about 12 to about 18 and X is a hydrogen atom.

10. A nonionic surfactant based, biodegradable, low-foaming liquid laundry detergent formulation, which consists essentially of (a) between about 17 and 23 percent by weight of one or more nonionic surfactants selected from the group consisting of alcohol ethoxylate surfactants and alkyl-substituted phenol ethoxylate surfactants having an average of between about 5 and 9 ethylene oxide units per ethoxylate molecule, (b) between about 2 and about 8 percent by weight of one or more carboxysulfonate compounds of the formula $$XOOC—\overset{(R^1)_p}{\overset{|}{C}}H(H)_q—\overset{(R^1)_q}{\overset{|}{C}}H(H)_p—\overset{O}{\overset{\|}{C}}—Z—CH_2—CH_2—SO3M, \quad (I)$$

wherein $R^1$ is selected from the group consisting of alkenyl or alkyl groups having a carbon numbers in the range of from about 12 to 18, p is 0 or 1, q is 0 when p is 1 and q is 1 when p is 0, X is selected from the group consisting of a hydrogen atom and an M cation, Z is selected from the group consisting of an oxygen atom and $—N(R^2)—$ groups wherein $R^2$ is $C_1$ to $C_4$ alkyl, and each M is a salt forming cation, with the further provision that the sum of components (a) and (b) is between about 20 and 30 percent by weight, (c) between about 3 and about 8 percent by weight of a silicate salt anticorrosion agent, (d) between about 2 and about 20 percent by weight of a detergent builder selected from the group consisting of phosphates and carboxylates and mixtures thereof, and (e) a sulfate salt filler.

11. The formulation of claim 10, wherein the one or more nonionic surfactants are alkanol ethoxylate surfactants derived from alkanols in the carbon number range from about 10 to 16 and having an average of between about 5 and 9 ethylene oxide units per ethoxylate molecule.

12. The formulation of claim 11, wherein the alkanols are predominantly linear, primary alkanols.

13. The formulation of claim 12, wherein the alkenyl and alkyl groups of the carboxysulfonate compounds are predominantly linear.

14. The formulation of claim 11, wherein component (b) comprises one or more carboxysulfonate compounds wherein Z represents an oxygen atom.

15. The formulation of claim 11, wherein component (b) comprises one or more carboxysulfonate compounds wherein Z represents a $—N(R^2)—$ group.

16. The formulation of claim 14, wherein the one or more carboxysulfonate compounds are a mixture of compounds wherein $R^1$ represents an alkenyl group having a carbon number in the range from about 12 to about 18 and X is a hydrogen atom.

17. The formulation of claim 15, wherein the one or more carboxysulfonate compounds are a mixture of compounds wherein $R^1$ represents an alkenyl group having a carbon number in the range from about 12 to about 18 and X is a hydrogen atom.

18. The formulation of claim 10, wherein component (b) comprises one or more carboxysulfonate compounds wherein Z represents an oxygen atom.

19. The formulation of claim 10, wherein component (b) comprises one or more carboxysulfonate compounds wherein Z represents a $—N(R^2)—$ group.

20. The formulation of claim 18, wherein the one or more carboxysulfonate compounds are a mixture of compounds wherein $R^1$ represents an alkenyl group having a carbon number in the range from about 12 to about 18 and X is a hydrogen atom.

21. The formulation of claim 19, wherein the one or more carboxysulfonate compounds are a mixture of compounds wherein $R^1$ represents an alkenyl group having a carbon number in the range from about 12 to about 18 and X is a hydrogen atom.

* * * * *